US009476271B2

(12) United States Patent
Judge et al.

(10) Patent No.: US 9,476,271 B2
(45) **Date of Patent: *Oct. 25, 2016**

(54) FLOW CONTROL SYSTEM

(71) Applicant: General Electric Company, Schenectady, NY (US)

(72) Inventors: Robert Arnold Judge, Houston, TX (US); Christopher Edward Wolfe, Niskayuna, NY (US); Fengsu Liu, Shanghai (CN); Li Liu, Shanghai (CN); Farshad Ghasripoor, Scotia, NY (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/405,922

(22) PCT Filed: Jun. 6, 2013

(86) PCT No.: PCT/US2013/044422

§ 371 (c)(1),
(2) Date: Dec. 5, 2014

(87) PCT Pub. No.: WO2013/184866

PCT Pub. Date: Dec. 12, 2013

(65) Prior Publication Data

US 2015/0122505 A1 May 7, 2015

(30) Foreign Application Priority Data

Jun. 7, 2012 (CN) ..... 2012 1 0186922

(51) Int. Cl.
*E21B 21/08* (2006.01)
*E21B 33/06* (2006.01)

(Continued)

(52) U.S. Cl.
CPC ..... *E21B 21/08* (2013.01); *E21B 17/01* (2013.01); *E21B 19/002* (2013.01);
(Continued)

(58) Field of Classification Search
CPC .... E21B 21/001; E21B 21/08; E21B 33/062; E21B 33/064; E21B 33/085
USPC ..... 166/368, 358, 363; 175/5, 48, 207
See application file for complete search history.

(56) References Cited

U.S. PATENT DOCUMENTS 4,273,212 A * 6/1981 Dorr et al. ..... 181/102
4,527,425 A * 7/1985 Stockton ..... 73/152.21

(Continued)

FOREIGN PATENT DOCUMENTS

CN 1034974 A 8/1989
CN 1039464 A 2/1990

(Continued)

OTHER PUBLICATIONS

International Invitation to Pay Additional Fees issued in connection with corresponding PCT Application No. PCT/US2013/044422 dated Apr. 17, 2014.

(Continued)

*Primary Examiner* — Matthew R Buck
(74) *Attorney, Agent, or Firm* — GE Global Patent Operation

(57) ABSTRACT

A flow control system for drilling a well comprises a conduit defining a channel configured to accommodate a drill pipe and a flow of a returning drilling fluid, and an acoustic sensor array configured to detect a flow rate of the returning drilling fluid. The flow control system further comprises a flow control device configured to control the flow rate of the returning drilling fluid and to be actuated in response to an event detected by the sensor array, the flow control device being proximate to the sensor array.

20 Claims, 3 Drawing Sheets

(51) Int. Cl.

| | |
|---|---|
| ***E21B 33/08*** | (2006.01) |
| ***E21B 47/06*** | (2012.01) |
| ***E21B 17/10*** | (2006.01) |
| ***E21B 47/10*** | (2012.01) |
| ***E21B 21/10*** | (2006.01) |
| ***E21B 17/01*** | (2006.01) |
| ***E21B 19/00*** | (2006.01) |
| ***E21B 21/00*** | (2006.01) |
| ***E21B 33/064*** | (2006.01) |
| ***E21B 47/00*** | (2012.01) |

(52) U.S. Cl.

CPC ..... *E21B 21/001* (2013.01); *E21B 21/10* (2013.01); *E21B 21/106* (2013.01); *E21B 33/064* (2013.01); *E21B 47/0001* (2013.01); *E21B 47/101* (2013.01)

(56) References Cited

U.S. PATENT DOCUMENTS

| | | | | |
|---|---|---|---|---|
| 4,640,372 | A | 2/1987 | Davis | |
| 5,006,845 | A * | 4/1991 | Calcar et al. | 367/81 |
| 5,163,029 | A | 11/1992 | Bryant et al. | |
| 5,214,251 | A * | 5/1993 | Orban et al. | 181/102 |
| 5,351,560 | A | 10/1994 | Russwurm | |
| 5,662,171 | A | 9/1997 | Brugman et al. | |
| 6,055,868 | A | 5/2000 | Koyano et al. | |
| 6,257,354 | B1 * | 7/2001 | Schrader et al. | 175/38 |
| 6,374,925 | B1 | 4/2002 | Elkins et al. | |
| 6,571,873 | B2 * | 6/2003 | Maus | 166/250.07 |
| 6,876,128 | B2 | 4/2005 | Nguyen | |
| 6,877,565 | B2 | 4/2005 | Edvardsen | |
| 6,904,982 | B2 | 6/2005 | Judge et al. | |
| 6,931,945 | B2 | 8/2005 | Takeda et al. | |
| 7,000,485 | B2 | 2/2006 | Ao et al. | |
| 7,270,185 | B2 | 9/2007 | Fontana et al. | |
| 7,407,019 | B2 | 8/2008 | Kinder et al. | |
| 7,497,266 | B2 * | 3/2009 | Fossli | 166/358 |
| 7,562,723 | B2 | 7/2009 | Reitsma | |
| 7,650,950 | B2 * | 1/2010 | Leuchtenberg | 175/48 |
| 7,823,463 | B1 | 11/2010 | Feller | |
| 7,866,399 | B2 | 1/2011 | Kozicz et al. | |
| 7,942,068 | B2 | 5/2011 | Ao et al. | |
| 8,066,062 | B2 | 11/2011 | Edvardsen et al. | |
| 8,322,432 | B2 | 12/2012 | Bailey et al. | |
| 8,403,059 | B2 | 3/2013 | Hughes et al. | |
| 8,794,062 | B2 * | 8/2014 | DiFoggio et al. | 73/152.19 |
| 9,016,381 | B2 | 4/2015 | Dietz | |
| 9,068,420 | B2 * | 6/2015 | Rajabi | E21B 21/08 |
| 9,080,427 | B2 * | 7/2015 | Ghasripoor et al. | |
| 2003/0168258 | A1 * | 9/2003 | Koederitz | 175/38 |
| 2006/0157282 | A1 * | 7/2006 | Tilton et al. | 175/65 |
| 2007/0095540 | A1 | 5/2007 | Kozicz et al. | |
| 2007/0151762 | A1 | 7/2007 | Reitsma | |
| 2008/0023917 | A1 | 1/2008 | Khandoker | |
| 2009/0249889 | A1 | 10/2009 | Kamimura | |
| 2009/0294129 | A1 | 12/2009 | Judge | |
| 2010/0175882 | A1 * | 7/2010 | Bailey et al. | 166/335 |
| 2010/0218937 | A1 | 9/2010 | Edvardsen et al. | |
| 2010/0288507 | A1 | 11/2010 | Duhe et al. | |
| 2011/0061872 | A1 * | 3/2011 | Mix et al. | 166/363 |
| 2011/0100710 | A1 * | 5/2011 | Fossli | 175/7 |
| 2012/0006613 | A1 | 1/2012 | Tseytlin | |
| 2012/0037361 | A1 * | 2/2012 | Santos et al. | 166/250.08 |
| 2013/0140034 | A1 * | 6/2013 | Ghasripoor et al. | 166/342 |
| 2013/0192847 | A1 | 8/2013 | Bailey et al. | |

FOREIGN PATENT DOCUMENTS

| | | | |
|---|---|---|---|
| CN | 102174887 | A | 9/2011 |
| GB | 2483671 | A | 3/2012 |
| WO | 0075477 | A1 | 12/2000 |
| WO | 2008051978 | A1 | 5/2008 |

OTHER PUBLICATIONS

International Search Report and Written Opinion issued in connection with corresponding PCT Application No. PCT/US2013/044422 dated Jul. 4, 2014.

Unofficial English translation of Chinese Office Action issued in connection with corresponding CN Application No. 201210186922.7 on Jun. 3, 2015.

U.S. Appl. No. 13/483,713, filed May 30, 2012, Farshad Ghasripoor.

* cited by examiner

FLOW CONTROL SYSTEM

BACKGROUND OF THE DISCLOSURE

This invention relates generally to flow control systems for controlling flows of fluids. More particularly, this invention relates to flow control systems for controlling flows of returning drilling fluids for kick prevention during the drilling of petroleum producing wells, such as offshore wells for hydrocarbons.

The exploration and production of hydrocarbons from subsurface formations have been done for decades. Due to the limited productivity of aging land-based production wells, there is growing interest in hydrocarbon recovery from new subsea wells.

Generally, for drilling an offshore well, a rotatable drill bit attached to a drill string is used to create the well bore below the seabed. The drill string allows control of the drill bit from a surface location, typically from an offshore platform or drill ship. Typically, a riser is also deployed to connect the platform at the surface to the wellhead on the seabed. The drill string passes through the riser so as to guide the drill bit to the wellhead.

During well drilling, the drill bit is rotated while the drill string conveys the necessary power from the surface platform. Meanwhile, a drilling fluid is circulated from a fluid tank on the surface platform through the drill string to the drill bit, and is returned to the fluid tank through an annular space between the drill string and a casing of the riser. The drilling fluid maintains a hydrostatic pressure to counterbalance the pressure of fluids coming from the well and cools the drill bit during operation. In addition, the drilling fluid mixes with material excavated during creation of the well bore and carries this material to the surface for disposal.

Under certain circumstances, the pressure of fluids entering the well from the formation may be higher than the pressure of the drilling fluid. This may cause the flow of the returning drilling fluid to be significantly greater than the flow of the drilling fluid in the drill string being presented to the well. Under exceptional circumstances, there is potential for catastrophic equipment failure and the attendant potential harm to well operators and the environment.

Well operators are keenly aware of the destructive potential of such unwanted influxes and continuously monitor drilling fluid inflows and outflows at the surface in order to detect surface changes in well flows. For example, the drilling fluid level in the fluid tank on the surface platform is monitored during circulation of the drilling fluid to determine if flow changes within the well are occurring. However, such methods may be imprecise and need a relatively longer time to detect and respond to a flow change within the well.

When an influx is detected, operators need to increase the hydrostatic pressure of the drilling fluid by shutting the well in with rams or annulars in a blow-out preventer that are intended for this purpose and then replacing the drilling fluid with fluid of higher density. This operation may take on the order of half a day and represent a significant impact on drilling productivity.

Therefore, there is a need for new and improved flow control systems for which may be used to detect pressure changes occurring during the creation of hydrocarbon production wells, and to control the flow of returning drilling fluids to surface platforms efficiently, for example offshore oil drilling platforms.

BRIEF DESCRIPTION OF THE DISCLOSURE

A flow control system for drilling a well is provided. The flow control system comprises a conduit defining a channel configured to accommodate a drill pipe and a flow of a returning drilling fluid, and an acoustic sensor array configured to detect a flow rate of the returning drilling fluid. The flow control system further comprises a flow control device configured to control the flow rate of the returning drilling fluid and to be actuated in response to an event detected by the sensor array, the flow control device being proximate to the sensor array.

A flow control system for kick prevention during well drilling is provided. The flow control system comprises a conduit defining a channel configured to accommodate a drill pipe and a flow of a returning drilling fluid, a sensor array configured to detect a flow rate of the returning drilling fluid, and a first holding element configured to hold the drilling pipe in the conduit and to control the flow of the returning drilling fluid in the conduit in response to the event detected by the sensor array.

A flow control system for kick prevention during well drilling is provided. The flow control system comprises a conduit defining a channel configured to accommodate a drill pipe and a flow of a returning drilling fluid; and a sensor array configured to detect a flow rate of the returning drilling fluid. The flow control system further comprises a holding element configured hold the drilling pipe in the conduit, and a by-pass subsystem in fluid communication with the conduit and configured to cooperate with the holding element to control the flow rate of the returning drilling fluid in response to an event detected by the sensor array.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION OF THE INVENTION

Preferred embodiments of the present disclosure will be described hereinbelow with reference to the accompanying drawings. In the following description, well-known functions or constructions are not described in detail to avoid obscuring the disclosure in unnecessary detail.

Figure 1:
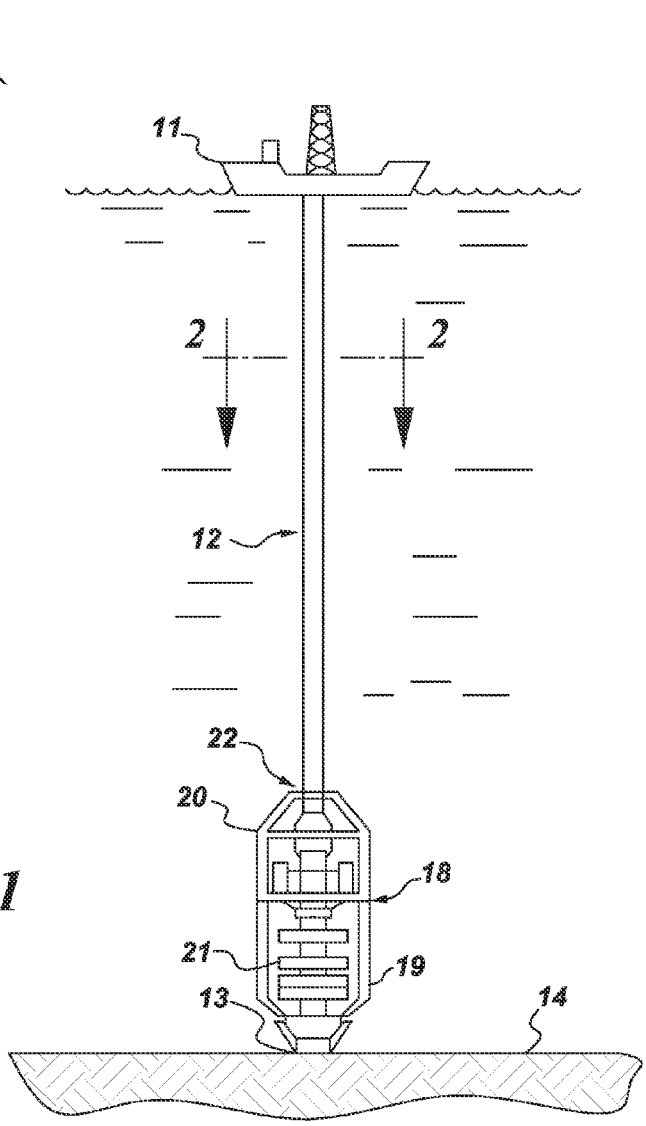
FIG. 1 is a schematic diagram of a drilling system in accordance with one embodiment of the invention.

FIG. 1 illustrates a schematic diagram of a drilling system 10 in accordance with one embodiment of the invention. In embodiments of the invention, the drilling system 10 is configured to drill wells for exploration and production of hydrocarbons, such as fossil fuels. Non-limiting examples of the wells include onshore and offshore wells. In one example, the drilling system 10 is configured to drill offshore wells.

Figure 2:
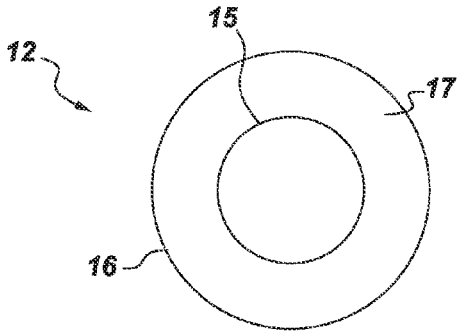
FIG. 2 is a schematic cross sectional diagram of a drilling assembly of the drilling system shown in FIG. 1 taken along a line A-A.

As illustrated in FIG. 1, the drilling system 10 generally comprises a platform 11 at a water surface (not labeled) and a drilling assembly 12 connecting the platform 11 and a wellhead 13 on a seabed 14. The drilling assembly 12 (as shown in FIG. 2) comprises a drill string 15, a drill bit (not shown), and a riser 16 to excavate a well bore (not shown).

The drill string 15 comprises a drill pipe formed from lengths of tubular segments connected end to end. The drill bit is assembled onto an end of the drill string 15 and rotates to perform the drill below the seabed 14. The drill string 15 is configured to convey the drill bit to extend the drill of the well below the seabed 14 and transmit a drilling fluid 100 (also referred to as a drilling mud, shown in FIG. 3) from the platform 11 into the well.

The riser 16 comprises a conduit having a tubular cross section and is typically formed by joining sections of casings or pipes. The drill string 15 extends within the riser 16 along a length direction (not labeled) of the riser 16. The riser 16 defines a channel configured to accommodate the drill string 15. An annular space 17 is defined between the drill string 15 and an inner surface (not labeled) of the riser 16 so that the riser 16 guide the drill string 15 to the wellhead 13 and transmit a returning drilling fluid 101 (shown in FIG. 3) from the well back to the platform 11.

Thus, during the drilling, the drill string 15 transmits the power needed to rotate the drill bit, and tethers the drill bit to the platform. Meanwhile, a drilling fluid 100 is circulated from the platform 11 through the drill string 15 to the drill bit, and is returned to the platform 11 as "returning" drilling fluid 101 through the annular space 17 between the drill string 15 and the inner surface of the riser 16.

The drilling fluid 100 maintains a hydrostatic pressure to counter-balance the pressure of fluids in the formation and cools the drill bit while also carrying materials excavated, such as cuttings including crushed or cut rock during drilling the well to the water surface. In some examples, the drilling fluid 100 from the platform 11 may comprise water or oil, and various additives. The returning drilling fluid 101 may at least include a mixture of the drilling fluid and the materials excavated during forming the well. At the water surface, the returning drilling fluid 101 may be treated, for example, be filtered to remove solids and then re-circulated.

As mentioned above, in certain applications, the pressure of the fluids in the formation may be higher than the pressure of the drilling fluid 100. This may cause the formation fluid to enter into the annular space 17 and join the returning drilling fluid 101 resulting in a greater returning flow. This influx is a kick, and if uncontrolled may result in a blowout.

Accordingly, in order to prevent kick or blowout, as illustrated in FIG. 1, the drilling system 10 further comprises a blowout preventer (BOP) stack 18 located adjacent to the seabed 14. Typically, the BOP stack 18 may include a lower BOP stack 19 and a Lower Marine Riser Package ("LMRP") 20 attached to an end of the riser 16, followed by a combination of rams and annular seals (not shown). During drilling, the lower BOP stack 19 and the LMRP 20 are connected.

A plurality of rams and annulars (or blowout preventers) 21 located in the lower BOP stack 19 are in an open state during a normal operation, but may interrupt or control the flow of the returning drilling fluid 101 passing through the riser 16 in a controlled state when a "kick" or "blowout" occurs based on different situations. As used herein, the term of "controlled state" means the blowout preventers 21 may close or reduce the flow of the returning drilling fluid in the riser 16. For example, the blowout preventers 20 may reduce the flow of the returning drilling fluid 101 in the riser 16 for kick prevention when a kick occurs.

As used herein, the term "reduce" means amounts of the returning drilling fluid is reduced but not closed so that the returning drilling fluid still passes through the riser 16 towards the platform. Alternatively, the blowout preventers 21 may close the flow of the returning drilling fluid in the riser 16 for kick prevention when a kick occurs.

It should be noted that the arrangement in FIG. 1 is merely illustrative. Some elements are not illustrated, for example controllers at least for controlling the blowout preventers 21 in the open state or in the controlled state, and electrical cables for transmitting signals from the platform to the controllers.

In some embodiments, in order to prevent the occurring of a kick or blowout, the drilling system 10 comprises a flow control system 22. In non-limiting examples, the flow control system 22 is configured to control the flow of the returning drilling fluid 101 in the riser 16 by applying back pressure thereon. In one example, the flow control system 22 is configured to control the flow of the returning drilling fluid 101 for kick prevention, which is also referred to as a kick prevention system. In some applications, the flow control system 22 is configured to control the flow of the returning drilling fluid 101 without stopping the drilling operation for kick prevention.

Figure 3:
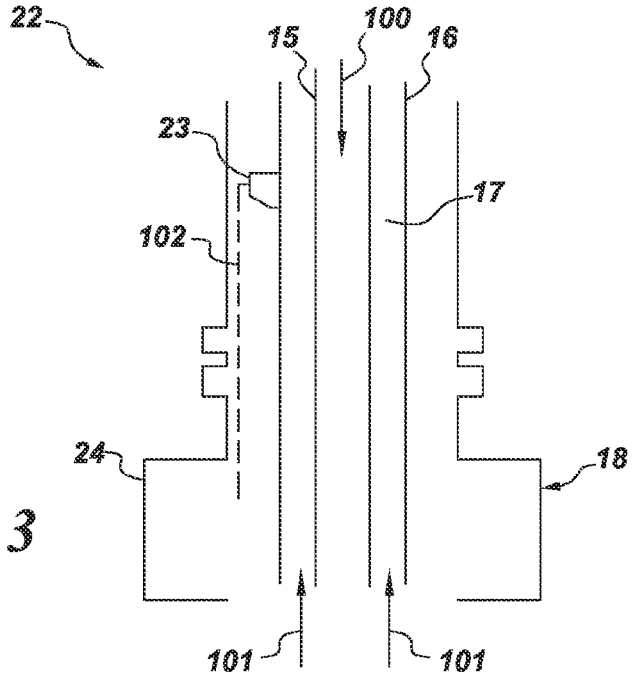
FIGS. 3-6 are schematic diagrams of a flow control system of the drilling system in accordance with various embodiments of the invention.

FIG. 3 illustrates a schematic diagram of the flow control system 22 in accordance with one embodiment of the invention. As illustrated in FIG. 3, the flow control system 22 comprises the riser 16, a sensor array 23, and a flow control device 24. As depicted above, the riser 16 is configured to accommodate the drill string 15 and the flow of the returning drilling fluid 101.

The sensor array 23 comprises one or more sensors disposed on the riser 16 and configured to detect a flow rate of the returning drilling fluid therein 101. A power line 102 from the BOP stack 18 powers the sensor array 23. In the illustrated example, the sensor array 23 comprises an acoustic sensor array including a plurality of sensors. The plurality sensors are spatially spaced from each other and disposed annularly around the riser 16.

Non-limiting examples of the acoustic sensor array 23 include Doppler or transit time ultrasonic sensors, which may have high detection accuracy. Alternatively, other suitable sensor array may also be employed. Although disposed on an outer surface of the riser 16 in FIG. 1, the sensor array 23 may also be disposed within or extend into the riser 16 to act as a wetted sensor array to contact the returning drilling fluid for detection.

The flow control device 24 is proximate to the sensor array 23 and configured to control the flow rate of the returning drilling fluid in the riser 16. The flow control device 24 is actuated in response to an event detected by the sensor array 23. As used herein, the term "event" means a kick and/or a blowout. In one example, the event comprises the kick. In the illustrated example, the flow control device 24 comprises the BOP stack 18.

During drilling, while the drill string conveys the drill bit to rotate to perform the drilling, the drilling fluid 100 is circulated from the platform 11 through the drill string 15 to the drill bit, and returned towards the platform 11 through the annular space 17 between the drill string 15 and the inner surface of the riser 16 in the form of the returning drilling fluid 101. Meanwhile, the sensor array 23 detects the flow rate of the returning drilling fluid 101 in the riser 16.

In non-limiting examples, when the flow rate of the returning drilling fluid 101 detected by the sensor array 23 may be above a predetermined value, which may means the pressure of the fluids in the formation is higher than the pressure of the drilling fluid 100, the flow control device 24 is actuated in response to flow levels detected by the sensor array 23 to control, for example to reduce the flow of the returning drilling fluid 101 so as to increase the pressure thereof in the riser 16 to balance the pressure of the fluids exiting the well so that the event detected by the sensor array 23 is prevented. After such an event is eliminated, the drilling returns to the normal operation.

In certain applications, the drill string 15 may vibrate during the drilling fluid 100 passes through so that the flow of the returning drilling fluid 101 may be unstable and impact the detection capability of the sensor array 23. In order to stabilize the drill string 15 during drilling so as to control the flow of the returning drilling fluid 101, as illustrated in FIG. 4, a flow control device 25 is provided.

Figure 4:
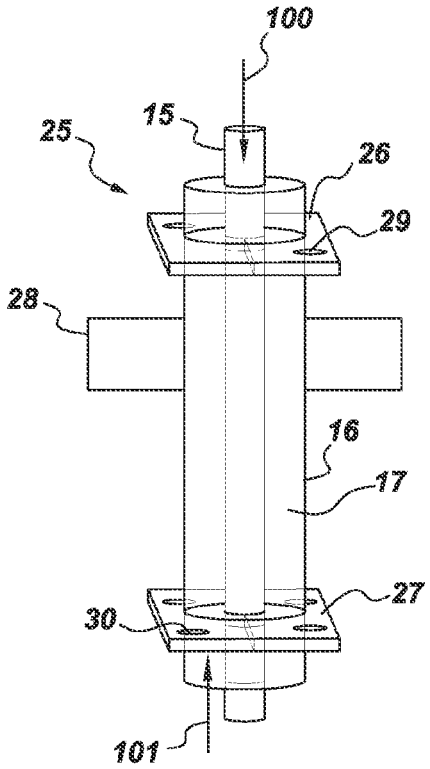

The arrangement in FIG. 4 is similar to the arrangement in FIG. 3. The two arrangements differ in that in the arrangement in FIG. 4, the flow control device 25 comprises first and second (or upper and lower) holding elements 26, 27 configured to hold and stabilize the drill string 15 within the riser 16. A sensor array 28 is disposed on the riser 16 located between the first and second holding elements 26, 27. Similarly, the sensor array 28 may comprise an acoustic sensor assay, and be disposed on the outer surface of the riser 16 or be disposed within or extend into the riser 16 to act as a wetted sensor array.

In the illustrated example, the first and second holding elements 26, 27 are disposed around the drill string 15 to hold the drill string 15 in the center of the riser 16, which may also be referred to as centralizers. In some examples, the first and/or second holding elements 26, 27 may extend beyond the riser 16. Alternatively, the first and/or second holding elements 26, 27 may be positioned within the annular space 17.

The first and second holding elements 26, 27 define a plurality of respective holes 29, 30 for the returning drilling fluids 101 passing through. The holes 29, 30 may have any suitable shapes, such circular shapes or rectangular shapes. In non-limiting examples, the numbers of the holes 29 on the first holding element 26 may be greater than the numbers of the holes 30 on the second holding element 27.

In certain applications, the holes 29 may act as restriction features to control the flow of the returning drilling fluid 101 passing through the annular space 17 in response to the event detected by the sensor array 28. Alternatively, other suitable restriction features may also be deployed on the first holding element 26 to control the returning drilling fluid 101 during the returning drilling fluid 101 passes through the riser 16.

In non-limiting examples, the sizes of the holes 29 may be adjusted based on different applications. For example, in the normal operation, the holes 29 are open entirely for the returning drilling fluid 101 passing through. In a controlled operation, the sizes of the holes 29 may be reduced to control, for example to reduce the flow of the returning drilling fluid 101 in the riser 16 for kick prevention.

Although the second holding element 27 is configured to centralize the drill string 15 within the riser 16, in certain applications, similar to the first holding element 26, the second holding element 27 may also be configured to control the flow of the returning drilling fluid 101 through restriction features, such as the holes 30 having adjustable sizes thereon.

During drilling, the sensor array 28 detects the flow of the returning drilling fluid 101 in the riser 16. In the normal operation, the returning drilling fluid 101 passes through the first and second holding elements 26, 27 towards the platform 11. In the controlled operation, the first and/or the second holding elements 26, 27 are actuated in response to the event detected by the sensor array 28 to reduce the flow of the returning drilling fluid 101 in the riser 16 to increase the pressure thereof for kick prevention through applying the back pressure to the well.

In non-limiting examples, the first and second holding elements 26, 27 may any suitable shapes, and may or may not be disposed within the BOP stack 18. In certain applications, the BOP stack 18 may optionally control the flow of the returning drilling fluid 101 during the flow control device 25 is working in the controlled operation. The second holding element 27 may be optionally employed.

Figure 5:
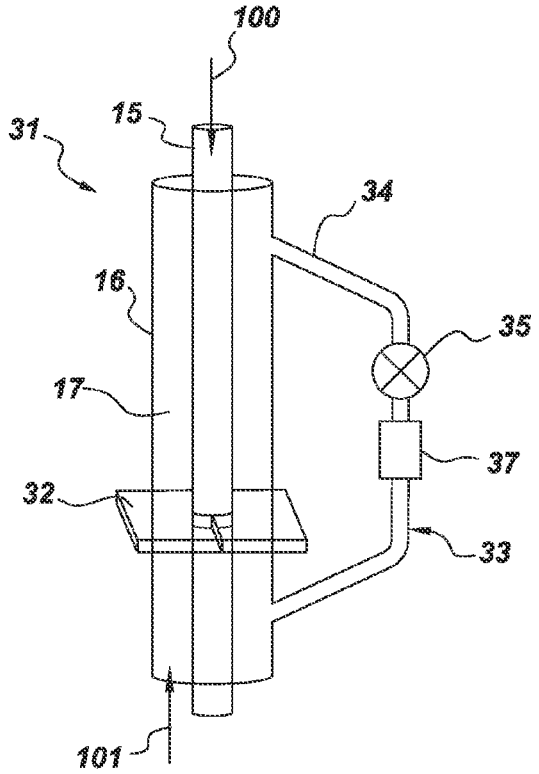

FIG. 5 illustrates a schematic diagram of a flow control system 31 in accordance with another embodiment of the invention. As illustrated in FIG. 5, the flow control system 31 comprises a holding element 32 configured to hold and stabilize the drill string 15 within the riser 16 and a bypass subsystem 33 in fluid communication with the riser 16.

The holding element 32 is disposed around the drill string 15 to hold the drill string 15 within the riser 16 and may have any suitable shapes. The holding element 32 may extend beyond the riser 16 or be disposed within the annular space 17. The by-pass subsystem 33 comprises a by-pass pipe 34 having two ends in fluid communication with the riser 16 and a flow controlling element 35 disposed on the by-pass pipe 34. The flow controlling element 35 may comprise a control valve, a choke or a conventional gate valve.

A sensor array 37 is disposed on the by-pass pipe 34 and the holding element 32 is located between the two ends of the by-pass pipe 34. The sensor array 37 may be disposed on an outer surface of the bypass pipe 34 or may be configured for the returning drilling fluid 101 passing through for detection. Non-limiting examples of the sensor array 37 include an acoustic sensor array or other suitable sensor arrays including, but not limited to a venturi or an orifice plate. For the illustrated arrangement, the sensor array 37 comprises one or more sensors.

During drilling, the drilling fluid 100 is circulated from the platform 11 through the drill string 15 to the drill bit. The holding element 32 stabilizes the drill string 15 in the riser 16. In certain applications, the holding element 32 is further configured to control the flow of the returning drilling fluid 101 in the riser 16. In one non-limiting example, the holding element 32 is configured to close the flow of the returning drilling fluid 101 in the riser 16 so that the returning drilling fluid 101 enters into the bypass subsystem 33.

Thus, the returning drilling fluid 101 enters into the bypass subsystem 33 to pass through the sensor array 37 and the flow controlling element 35. The sensor array 37 detects the flow rate of the returning drilling fluid 101 and the flow controlling element 35 controls the flow of the returning drilling fluid 101 when the sensor array 37 detects the event occurs. Accordingly, the bypass subsystem 33 cooperates with the holding element 32 to act as a flow control device to control the flow of the returning drilling fluid in response to the event detected by the sensor array 37.

In other examples, similar to the holding element 26, the holing element 32 may not close but reduce the flow of the returning drilling fluid 101 in the riser 16 in response to the detection of the sensor array 37. Similarly, the flow control system 31 may or may not be disposed within the BOP stack 18, and the BOP stack 18 may also optionally be employed to control the flow of the returning drilling fluid 101.

Figure 6:
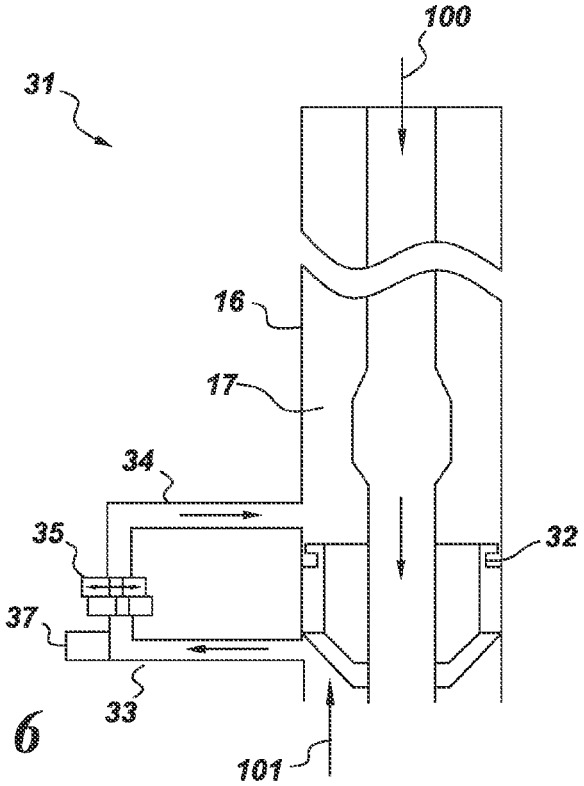

FIG. 6 illustrates a schematic diagram of the flow control system 31 show in FIG. 5 in accordance with another embodiment of the invention. The arrangement in FIG. 6 is similar to the arrangement in FIG. 5. As illustrated in FIG. 6, the holding element 32 has an annular shape. The sensor array 37 is disposed on the outer surface of the bypass pipe 34. The drill string 15 passes through the annular holding element 32, which is disposed within the riser 16 to hold the drill string 15 therein. During drilling, the holding element 32 closes the flow of the returning drilling fluid 101 in the riser 16.

In embodiments of the invention, the flow control system is employed to control the flow of the returning drilling fluid in the riser to prevent the event detected by the sensor array occurs. In non-limiting examples, the flow control system is employed to control the flow of the returning drilling fluid in the riser by applying back pressure thereon without stopping the drilling operation for kick prevention. After the event detected by the sensor is eliminated, the drilling returns to the normal operation.

The flow control system comprises the sensor array having higher detection accuracy, and the one or more holding elements configured to stabilize the drill string so as to improve the detection of the sensor array to the flow rate of the returning drilling fluid. Further, the one or more holding elements may also be employed to control the flow of the returning drilling fluid. In addition, the bypass subsystem is also employed to detect and control. The configuration of the flow control system is relatively simple and responds rapidly to the event detected by the sensor array. The flow control system may be used to retrofit conventional drilling systems.

While the disclosure has been illustrated and described in typical embodiments, it is not intended to be limited to the details shown, since various modifications and substitutions can be made without departing in any way from the spirit of the present disclosure. As such, further modifications and equivalents of the disclosure herein disclosed may occur to persons skilled in the art using no more than routine experimentation, and all such modifications and equivalents are believed to be within the spirit and scope of the disclosure as defined by the following claims.

What is claimed is:

1. A flow control system for drilling a well, the system comprising:

a conduit defining a channel configured to accommodate a drill pipe and a flow of a returning drilling fluid;

a sensor array configured to detect a flow rate of the returning drilling fluid; and a flow control device comprising a first holding element and a second holding element, each configured to hold the drill pipe in the conduit and each defining a plurality of holes configured to control the flow rate of the returning drilling fluid and to be actuated in response to an event detected by the sensor array, the flow control device being proximate to the sensor array.

2. The flow control system of claim 1, wherein the flow control system is configured for kick prevention during drilling offshore wells, and wherein the flow control device is configured to reduce the flow rate of the returning drilling fluid in the conduit.

3. The flow control system of claim 1, wherein the sensor array is an ultrasonic sensor array.

4. The flow control system of claim 1, wherein the flow control device comprises a blowout prevention stack.

5. The flow control system of claim 1, wherein the first holding element is configured to hold the drilling pipe in the conduit.

6. The flow control system of claim 5, wherein the second holding element is disposed below the first holding element and configured to hold the drilling pipe in the conduit, and wherein the sensor array is disposed on the conduit and located between the first and second holding elements.

7. The flow control system of claim 6, wherein the first and second holding elements are disposed around the drilling pipe.

8. The flow control system of claim 7, wherein sizes of the holes defined on one of the first and second holding elements are adjustable to reduce the flow rate of the returning drilling fluid passing through the conduit in response to the event detected by the sensor array.

9. The flow control system of claim 1, wherein the flow control device further comprises a by-pass subsystem configured to control the flow rate of the returning drilling fluid therein.

10. The flow control system of claim 9, wherein the by-pass subsystem comprises a by-pass pipe having two ends in fluid communication with the conduit and a valve disposed on the by-pass pipe to control the flow rate of the returning drilling fluid in the by-pass pipe, wherein the sensor array is disposed on the by-pass pipe, and wherein at least one of the first holding element and the second holding element is located between the two ends of the by-pass pipe.

11. The flow control system of claim 10, wherein at least one of the first holding element and the second holding element has an annular shape and is disposed within the conduit and around the drilling pipe.

12. The flow control system of claim 9, wherein the flow control device is configured to close the flow of the returning drilling fluid in the conduit in response to the event detected by the sensor array.

13. A flow control system for kick prevention during well drilling, the system comprising:

a conduit defining a channel configured to accommodate a drill pipe and a flow of a returning drilling fluid;

a sensor array configured to detect a flow rate of the returning drilling fluid; and a first holding element and a second holding element, each configured to hold the drill pipe in the conduit and each defining a plurality of holes configured to control the flow rate of the returning drilling fluid in the conduit in response to an event detected by the sensor array.

14. The flow control system of claim 13, wherein the second holding element is disposed below the first holding element and wherein the sensor array is disposed on the conduit and located between the first and second holding elements.

15. The flow control system of claim 14, wherein the first and second holding elements are disposed around the drilling pipe.

16. The flow control system of claim 15, wherein at least one of the first and second holding elements is configured to control the flow rate of the returning drilling fluid by adjusting sizes of the respective holes thereon.

17. The flow control system of claim 15, wherein at least one of the first and second holding elements is configured to reduce the returning drilling fluid passing through the conduit in response to the event detected by the sensor array.

18. A flow control system for kick prevention during well drilling, the system comprising:

a conduit defining a channel configured to accommodate a drill pipe and a flow of a returning drilling fluid;

a sensor array configured to detect a flow rate of the returning drilling fluid;

a first holding element and a second holding element, each configured to hold the drill pipe in the conduit and each defining a plurality of holes configured to control the flow rate of the returning drilling fluid; and a by-pass subsystem in fluid communication with the conduit and configured to cooperate with at least one of the first holding element and the second holding element to control the flow rate of the returning drilling fluid in response to an event detected by the sensor array.

19. The flow control system of claim 18, wherein the first holding element and the second holding element are disposed around the drilling pipe and within the conduit, and configured to close the flow of the returning drilling fluid in the conduit.

20. The flow control system of claim 18, wherein the by-pass subsystem comprises a bypass pipe having two ends in fluid communication with the conduit and a valve disposed on the bypass pipe, wherein the sensor array is disposed on the bypass pipe, and wherein at least one of the first holding element and the second holding element is located between the two ends of the bypass pipe.

* * * * *